US006495961B1

(12) United States Patent
Heinrich et al.

(10) Patent No.: US 6,495,961 B1
(45) Date of Patent: Dec. 17, 2002

(54) TWT POWER SUPPLY WITH IMPROVED DYNAMIC RANGE

(75) Inventors: Richard Johann Heinrich, Marlton, NJ (US); Lucas John Bazin, Shamong, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/911,931

(22) Filed: Jul. 24, 2001

(51) Int. Cl.[7] ..... H01J 25/34
(52) U.S. Cl. ..... 315/3.5; 315/39.3; 315/94
(58) Field of Search ..... 315/3.5, 39.3, 315/94; 363/61, 68, 97

(56) References Cited

U.S. PATENT DOCUMENTS 4,777,406 A * 10/1988 Ross et al. ..... 315/3.5
4,816,978 A * 3/1989 Domenget et al. ..... 363/21
4,821,165 A * 4/1989 Gunn ..... 363/60
4,866,344 A * 9/1989 Ross et al. ..... 315/3.5
4,945,464 A * 7/1990 Gunn ..... 363/61

* cited by examiner

*Primary Examiner*—Don Wong
*Assistant Examiner*—Hoang Nguyen
(74) *Attorney, Agent, or Firm*—Duane Morris LLP

(57) ABSTRACT

A power supply for a travelling-wave tube (TWT) includes a beam power supply (14) connected to the cathode and collector of the TWT, and a further power supply (20) connected to ground and to the collector for establishing the cathode-to-body voltage. A feedback cathode voltage regulator includes a transresistance arrangement (31) connected between ground and a terminal of the further power supply which, in one version, includes a cascade of a control transresistance device (32) with a plurality of further transresistance devices (234*s*) for reducing the voltage to which the control device is subjected. In another version, a plurality of such transresistance arrangements (A,B) are paralleled for reducing the power which any one device must handle. In a preferred embodiment, a current equalizer (240) equalizes the load carried by each of the transresistance arrangements (A,B).

11 Claims, 2 Drawing Sheets

210

TWT POWER SUPPLY WITH IMPROVED DYNAMIC RANGE

FIELD OF THE INVENTION

This invention relates to power supplies, and more particularly to power supplies for high-voltage pulse applications, such as in a radar system using a travelling-wave tube transmitter.

BACKGROUND OF THE INVENTION

Radar systems have been used for more than fifty years, and during that time many varieties have emerged, including continuous-wave varieties. Many radar systems continue to use relatively short, high-power pulses of radio-frequency electromagnetic radiation to detect, locate and track targets. Modern radars provide very sophisticated features and capabilities at long range on small targets. In order to provide such features and capabilities, the recurrently transmitted electromagnetic pulses are often required to meet stringent frequency, power, and stability criteria while executing a recurrent program involving changing frequency and power.

In general, high performance in a radar system depends upon having a large bandwidth, so that at some times very short-duration pulses can be transmitted for making fine determinations of distance and dimensions, and at other times much longer-duration pulses can be transmitted for long-range detection. At one time, radar systems used simple vacuum tubes in their transmitters, but the power and frequency limitations of such tubes made them somewhat unsatisfactory. The development of the klystron and magnetron provided increased power at high frequencies, but with limited bandwidth. Modern radar systems use broadband sources of transmitted electromagnetic radiation, which are often in the form of one or more travelling-wave tubes (TWTs), and sometimes of arrays of solid-state transistors. At the current state of technology, the highest power with wide bandwidth is available with travelling-wave tubes.

FIG. 1 is a simplified diagram in block and schematic form, illustrating a prior-art travelling-wave tube power supply 10. In general, stability of the transmitted pulse from a travelling-wave tube, such as 12 of FIG. 1, can be achieved by maintaining constant the various TWT electrode voltages. In the simplest type of high-power TWT transmitter, a travelling wave tube, such as 12, is energized by a voltage supply, such as 14 of FIG. 1, connected to its cathode 12*ca* and collector 12*co*. Such an arrangement sets the power dissipation of the TWT to equal the product of the tube current and the voltage of source 14. The actual tube voltage and power are often determined by considerations including the best linearity or least distortion introduced by the tube. In an actual system, the voltage of power supply 14 may be about 35 kilovolts (kv). This type of supply can be effective, but the unavoidable internal impedance of the power supply 14 undesirably results in a decrease of the applied voltage each time an energy pulse is produced by the TWT 12.

In order to reduce the voltage drop attributable to the internal impedance of the power supply 14 of FIG. 1, the prior art parallels the power supply with an energy storage capacitor, illustrated as 16 in FIG. 1. The energy storage capacitor tends to reduce the instantaneous voltage drop at the inception of the pulse, but a voltage decrease or "droop" still occurs over the duration of the transmitted pulse. A sufficiently large energy storage capacitor 16 can, however, keep the voltage droop within acceptable limits. The presence of the energy storage capacitor 14, in turn, results in the possibility of a large current discharge in the event of a short-circuit or flashover within the TWT. A current-limiting resistor 18 is introduced in a serial connection between the TWT cathode and the combination of the power supply 14 and the capacitor 16, to prevent damage to the TWT and power supply.

It should be noted at this point that the terms "between" and "across," and certain other terms, have meanings in electrical usage which are different from those commonly used. More particularly, the terms have meanings which are not related to physical placement, but rather relate to the terminals to which electrical coupling is made. Thus, signal flow "between" A and B takes place if the signal leaves one of A and B and arrives at the other, regardless of whether the path taken happens to lie on, or pass through, a straight line extending from A to B. Those skilled in the art know this so thoroughly that little though is given to the use of the terms, and they are automatically understood.

It has been found that greatest modulation sensitivity (somewhat corresponding to "gain") of a travelling-wave tube occurs at specific values of voltage between the cathode 12*ca* and the body 12*b* of the tube 12. The body 12*b* of the TWT 12 should be grounded, for reasons of safety and to reduce the possibility of flashover. In general, the maximum-modulation-sensitivity cathode-to-body voltage does not correspond with the optimum cathode-to-collector voltage of the TWT. In order to obtain maximum modulation sensitivity of TWT 12 of FIG. 1, a second voltage or power supply 20 is provided, with its negative (–) terminal coupled to the collector 12*co* of TWT 12 by way of a current-limiting resistor 22, and with its positive (+) terminal coupled essentially to ground, by way of a control or regulator arrangement designated generally as 30. The voltage produced by power supply 20 introduces an offset voltage which drives all the voltages associated with the TWT in a negative direction, except for the ground voltage at 12*g* applied to the TWT body connection 12*b*. The voltage of power supply 20 is selected to a value which sets the cathode-to-ground voltage to about the maximum-modulation-sensitivity voltage, which is to say that the floating voltages of power supply 14 are driven negative until the cathode 12*ca* of TWT 12 is at the desired negative voltage relative to the ground voltage at body terminal 12*b*. In one application, the voltage of power supply 20 is about 8 kilovolts, which sets the cathode-to-ground voltage at about –43 kv. The voltage offset introduced by power supply 20 does not change the power dissipation of the TWT, because power supply 14 continues to establish the voltage (about 35 kv in the example) between cathode 12*ca* and collector 12*co*. Thus, the arrangement of FIG. 1 as so far described maintains the cathode-to-body voltage of the TWT near the optimum for modulation sensitivity, and the cathode-to-collector voltage at some value optimized for a combination of signal distortion and TWT dissipation.

In the arrangement of FIG. 1, power supply 20 is also associated with a collector energy storage capacitor 24, which serves the same purpose for power supply 20 as energy storage capacitor 16 serves for power supply 14. It will be appreciated that the internal impedances of power supplies 14 and 20 necessarily result in reduction of TWT voltage when current is drawn, whether or not the power supplies are paralleled by energy storage capacitors. For very short pulses, such energy storage capacitors can be very helpful in ameliorating voltage drop. However, as the desired transmitted pulses become longer (of longer duration or of increased duty cycle), the size of the requisite energy storage capacitance can itself become a problem. In a large, high-power radar system using an energy storage capacitor across the cathode-to-collector path of a TWT, the weight of energy storage capacitors can be hundreds of pounds, which may be undesirable for some applications.

To the extent that transmitted frequency and power do not conform to the desired pattern or program because of variation in the power supply voltages of the TWT of a radar transmitter, signal processing can in some instances be used to compensate for the resulting deficiencies. In general, reduction in the amount of signal processing is desirable, both for reducing the amount of processing power required, and therefore the costs of the system, and for increasing the processing speed, thereby allowing improved performance. The need for additional processing in order to compensate for deficiencies in the radar transmitter characteristics, then, suggests that it is desirable to further stabilize the power supplies associated with a TWT transmitter. As mentioned, one way to do this is to increase the sizes of the energy storage capacitors, but this may not be desirable or possible, and the desired level of stability of the cathode 12*ca* voltage relative to ground at the body terminal 12*b* may not be achievable without very large energy storage capacitors. The magnitude of the problem may be understood by considering that the allowable variation of the cathode-to-ground voltage may be one or two volts out of 40 or more thousands of volts. An additional aspect of the problem associated with the use of ever-larger energy storage capacitors is that the arrays of capacitors, by virtue of their large size, introduce irreducible inductance into the power-supply circuits, which adversely affects their effectiveness in reducing droop in the presence of very short-duration pulses.

In the power supply of FIG. 1, the control circuit 30 provides a measure of feedback voltage control which tends to reduce the effective or dynamic internal impedance of the combined power supplies 14 and 20. In general, control circuit 30 includes a controllable resistance element 31 consisting of a control FET 32 having its source connected to ground by way of a sensing resistor 33 and its drain connected to the positive (+) terminal of power supply 20 by way of a tetrode 34. The gate 32*g* of FET 32 is connected to the output port 36*o* of a cathode voltage control circuit illustrated as a box 36. A cathode voltage sensing input port 30*c* of block 36 is connected, by a sense conductor or "line" 36*s,* to sense the "cathode" voltage at the negative (−) terminal of power supply 14. Block 36 internally compares the cathode voltage with a reference voltage to produce an error voltage at its output port 36*o,* and provides the error voltage to the gate 32*g* of FET 32, all in known fashion. Tetrode 34 is connected between the drain of FET 32 and the positive terminal of power supply 20 to keep the FET drain voltage within a range which the solid-state FET 32 can handle. When the beam voltage regulator 30 of FIG. 1 is in operation, the dynamic impedance of the combined power supplies 14, 20 supplying the cathode 12*ca* of the TWT 12 relative to ground is much reduced from that which it would have in an open-loop or unregulated condition. The reduction in effective internal impedance of the combined power supplies may be used directly to improve the voltage stability at the cathode 12*ca* of TWT 12, or may be used to reduce the sizes of the energy storage capacitors, or both.

It should be noted that each of the power supply or voltage source blocks 14 and 20 of FIG. 1 may have their own internal negative-feedback controls for setting their output voltages and for reducing their effective internal impedances.

As performance requirements of radar systems increase, with increasing requirements for both short- and long-pulse operation, it has been found that the power supply 10 of FIG. 1 can no longer be used, because the shorter transmitter pulses are outside the useful bandwidth of the controller. In some cases, operation with short pulses may even cause regeneration, which may require that the feedback control circuit be deactivated during the transmitted pulse.

SUMMARY OF THE INVENTION

A power supply for a travelling-wave tube (TWT) according to an aspect of the invention provides voltage for the cathode-to-collector beam of a travelling-wave tube. The travelling-wave tube includes a cathode, a collector, and a body connected to ground or other reference voltage source. The power supply includes a first voltage source including a negative (−) terminal and a positive (+) terminals coupled to the collector of the travelling-wave tube. An electrical coupling arrangement, such as a conductor or a current-limiting resistor, is coupled to the negative terminal of the first voltage source and to the cathode of the travelling-wave tube, for thereby establishing a cathode-to-collector voltage of the travelling-wave tube at a value near the first voltage. The power supply also includes a controllable impedance including a first terminal coupled to the ground (or other reference) and also including a second terminal. The controllable impedance further includes a control terminal responsive to a control signal for controlling the impedance between the first and second terminals of the controllable impedance. In a particular embodiment, the controllable impedance comprises (a) a sensing resistor having one end coupled to the ground (or other reference); (b) a first controllable solid-state device including first and second electrodes, and a control electrode to which a control signal can be applied for controlling the impedance between the first and second electrodes. The first controllable solid-state device has its first electrode coupled to the ground (or other) reference by way of the sensing resistor, and also has its control electrode coupled to (or in common with) the control terminal of the controllable impedance. The controllable impedance also includes (b) at least two additional controllable solid-state devices, each of the additional controllable solid state device including first and second electrodes and a control electrode to which a control signal can be applied for controlling the impedance between the first and second electrodes. The additional controllable solid-state devices are in a cascade in which each such cascaded additional solid-state device, except those at the ends of the cascade, has its second electrode coupled to the first electrode of the next adjacent one of the additional controllable solid-state devices in the cascade, and in which the first electrode of that one of the additional controllable solid-state devices at a first end of the cascade is connected to the second electrode of the first controllable solid-state device, and in which the second electrode of that one of the additional controllable solid-state devices at a second end of the cascade is connected to, or common with, the second terminal of the controllable impedance. Additionally, the controllable impedance includes (c) means for equalizing the voltages applied between the first and second terminals of the additional controllable solid-state devices. The power supply further includes a second voltage source including a negative (−) terminal coupled to the collector of the travelling-wave tube and a positive (+) terminal connected to the second terminal of the controllable impedance, and a cathode-to-ground voltage controller coupled to the cathode of the travelling-wave tube, to the ground, and to the control terminal of the controllable impedance, for controlling the control signal in a manner which tends to maintain the voltage between the ground and the cathode of the travelling-wave tube constant. In an embodiment of the invention, the voltage controller is of the feedback type.

In a preferred embodiment, the power supply further comprises a capacitance arrangement coupled across the first voltage source. In another embodiment, the means for equalizing the voltages includes a resistive voltage divider defining plural taps, with the taps of the resistive voltage divider being connected to the control electrodes of the additional controllable solid-state devices. In yet another embodiment of the invention, a second controllable impedance includes a first terminal coupled to the ground (or other reference) and also includes a second terminal coupled to the negative terminal of the second voltage source, the second controllable impedance further including a control terminal responsive to a control signal for controlling the impedance between the first and second terminals of the controllable impedance, and means are provided for coupling the cathode-to-ground voltage controller to the control electrodes of the first-mentioned and second controllable impedances, for parallel control of the first-mentioned and second controllable impedances. In one manifestation of this last embodiment, means are provided for tending to equalize the current through each of the first-mentioned and second controllable impedances, and in one version, this means includes a first sensing resistor coupled between the ground and the first electrode of the first controllable solid-state device for developing a signal representing the current through the first controllable solid-state device, and a second sensing resistor connected between the first terminal of the second controllable impedance and the ground for developing a signal representing the current through the second controllable impedance, together with first and second amplifiers, each including an inverting input port and a noninverting input port, the inverting input ports of the first and second amplifiers being connected to the first and second sensing resistors, respectively, and the noninverting input ports of the first and second amplifiers being connected in common to the cathode-to-ground voltage controller for receiving the control signal therefrom.

Another avatar of the invention lies in a power supply for the cathode-to-collector beam of a travelling-wave tube including a cathode, a body connected to ground (or other reference potential), and a collector. In this avatar, the power supply comprises a first direct voltage source including a negative terminal, and also includes a positive terminal coupled to the collector of the travelling-wave tube. An electrical coupling means is coupled to the negative terminal of the first voltage source and to the cathode of the travelling-wave tube, for thereby establishing a cathode-to-collector voltage of the travelling-wave tube at a value near, or ideally at, the first voltage. A first controllable impedance includes a first terminal coupled to the ground (or other reference) and also includes a second terminal. The first controllable impedance further includes a control terminal responsive to a control signal for controlling the impedance between the first and second terminals of the first controllable impedance. A second controllable impedance includes a first terminal coupled to the ground (or other reference) and also includes a second terminal. The second controllable impedance further includes a control terminal responsive to a control signal for controlling the impedance between the first and second terminals of the second controllable impedance. A second voltage source includes a negative terminal coupled to the collector of the travelling-wave tube and a positive terminal connected to the second terminal of the first and second controllable impedances, and a cathode-to-ground voltage controller coupled to the cathode of the travelling-wave tube, to the ground (or other reference), and to the control terminals of the first and second controllable impedances, for controlling the control signal in a manner which tends to maintain constant the voltage between the ground (or other reference) and the cathode of the travelling-wave tube.

In a particular manifestation of this avatar, a capacitance means is coupled across the first voltage source. In another particular manifestation, the coupling means comprises a resistance. In one version of this avatar, each of the controllable impedances comprises (a) a resistor having one end coupled to the ground or other reference, (b) a first controllable solid-state device including first and second electrodes, and a control electrode to which a control signal can be applied for controlling the impedance between the first and second electrodes. This first controllable solid-state device has the first electrode coupled to the ground (or other reference) by way of the resistor, and also has the control electrode coupled to the control terminal of the controllable impedance. This version of the avatar also includes (b) at least two additional controllable solid-state devices, where each the additional controllable solid state device includes first and second electrodes and a control electrode to which a control signal can be applied for controlling the impedance between the first and second electrodes. The additional controllable solid-state devices are coupled in a cascade in which each such cascaded solid-state device, except those at the ends of the cascade, has its second electrode coupled to the first electrode of the next adjacent one of the additional controllable solid-state devices in the cascade, and in which the first electrode of that one of the additional controllable solid-state devices at a first end of the cascade is connected to the second electrode of the first controllable solid-state device, and in which the second electrode of that one of the additional controllable solid-state devices at a second end of the cascade is connected to the second terminal of the controllable impedance; and (c) means for equalizing the voltages applied between the first and second terminals of the additional controllable solid-state devices.

DESCRIPTION OF THE INVENTION

Figure 1:
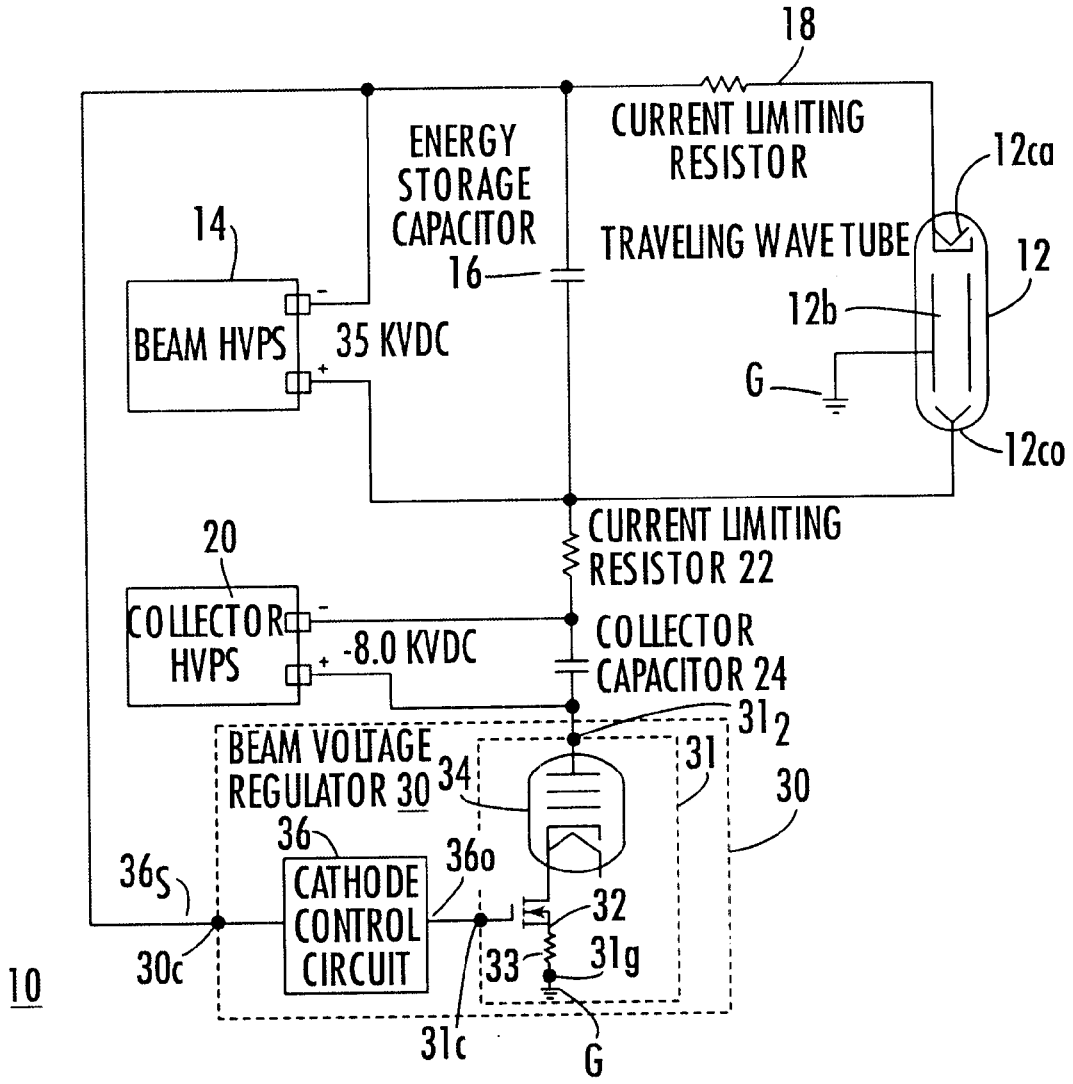
FIG. 1. (PRIOR ART)
FIG. 1 is a simplified diagram in block and schematic form of a travelling-wave-tube (TWT) power supply according to the prior art.
Figure 2:
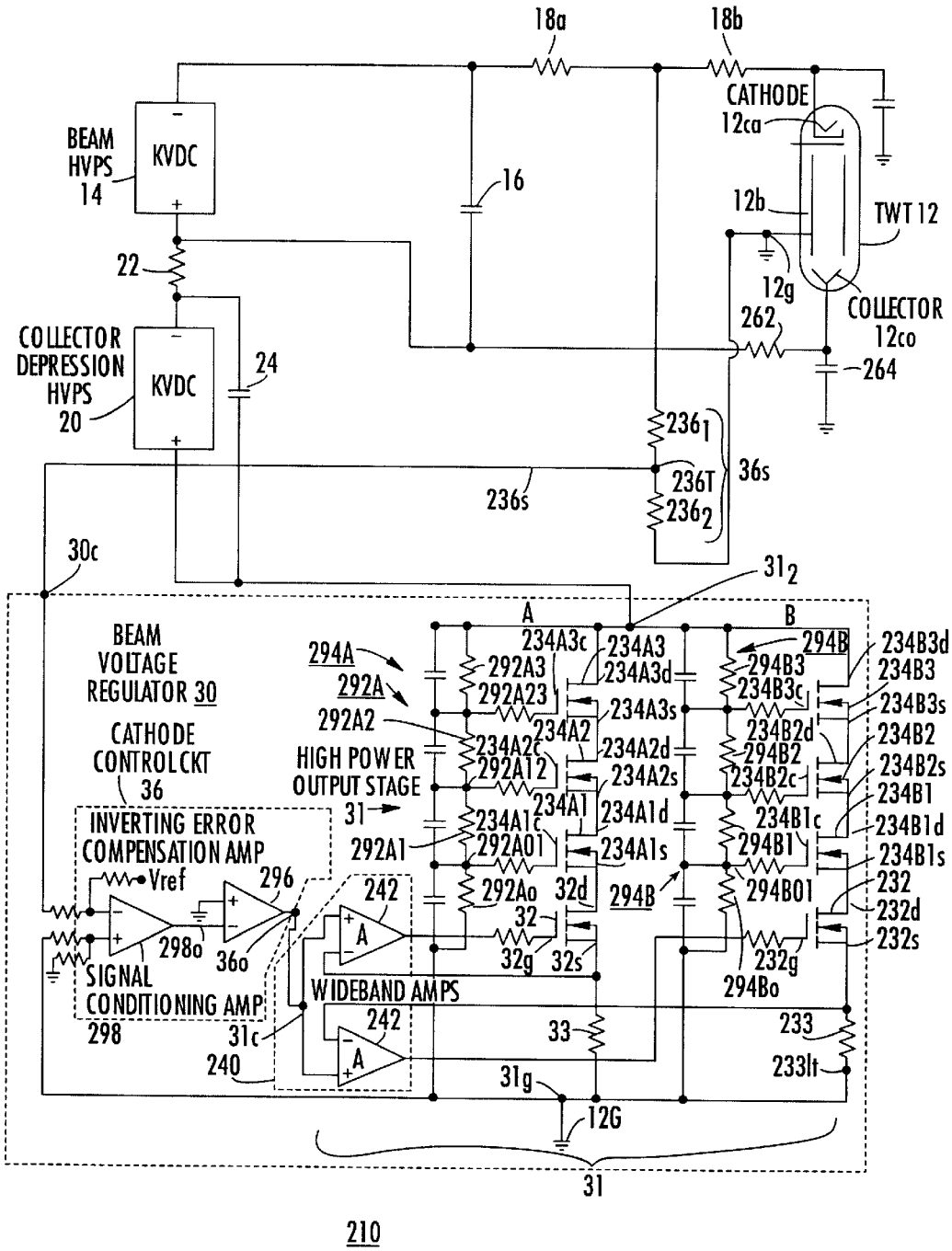
FIG. 2 is a simplified diagram in block and schematic form of a travelling-wave-tube power supply according to an aspect of the invention.

In FIG. 2, elements corresponding to those of FIG. 1 are designated by like reference numerals. In FIG. 2, a travelling-wave-tube power supply is designated generally as 210. In power supply 210, the cathode voltage sensing connection 36*s* includes a resistive voltage divider including resistors $\mathbf{236}_1$ and $\mathbf{236}_2$, and a tap 237T connected therebetween. These resistors could, in principle, be physically placed within cathode control circuit 36, but because of the high voltages involved, are preferably placed without the power supply control circuits. The tap 236T is connected by way of a signal path or conductor 236*s* to the control signal input port 30*c* of beam voltage regulator 30, and the control signal coupled from the tap 236T to control signal input port 30*c* is a small proportion of the cathode voltage.

Within beam voltage regulator 30 of FIG. 2, cathode control circuit 36 is seen to include a signal conditioning amplifier and error compensation amplifier 298 which receives the control signal from port 30*c* at its inverting (−) input terminal, offset by a source of reference voltage Vref, and which has its noninverting (+) input terminal coupled to TWT ground 12*g*. The output of amplifier 298 at output port 298*o* is a representation of the control signal, translated, if necessary, to a different range of voltage values. The output signal produced by amplifier 298 at port 298*o* is applied to the inverting (−) input terminal of a differential amplifier 296, which has its noninverting (+) input terminal connected to ground. Differential amplifier 296 compares the sensed control signal with the reference voltage, and produces an error signal at output port 36*o* of cathode control circuit 36. The error signal indicates the direction and magnitude of the correction required to maintain the desired cathode voltage.

The error voltage at output port 36*o* of cathode control circuit 36 of FIG. 2 is applied to the input port 31*c* of controllable resistance element 31. Controllable resistance element 31 also includes two paralleled controllable resistance elements designated generally as A and B, so as to divide the power being controlled between the two separate controllers. Controller or controllable resistance element A includes a transresistance element in the form of a FET 32 including a source 32*s*, a drain 32*d*, and a control electrode 32*g*. Source 32*s* is connected to one terminal of a sense resistor 33, the other end of which is connected to ground G. Drain 32*d* of FET 32 is connected to terminal $\mathbf{31}_2$ of beam voltage regulator 30 by a cascade 294A of additional transresistance devices, which are illustrated as being FETs, but which might be any solid-state transresistance devices. Cascade 294A includes a FET 234A1 having source 234A1*s*, drain 234A1*d*, and a control electrode or gate 234A1*c*, a FET 234A2 having source 234A2*s* connected to the drain 234A1*d* of FET 234A1, a drain 234A2*d*, and a control electrode or gate 234A1*c*, a FET 234A3 having a drain 234A3*d*, a control electrode or gate 234A3*c*, and a source 234A3*s* connected to the drain 234A1*d* of FET 234A2. Thus, within the main portion of cascade 294A, each FET, such as FET 234A2, has its source, such as source 234A2*s*, connected to the drain, such as drain 234A1*d*, of the next adjacent FET, 234A1, on one side in the cascade 294A, and has its drain, such as drain 234A2*d*, connected to the source, such as source 234A3*d*, of the next adjacent FET, 234A3, on the other side of it in the cascade 294A. The last transresistance device on the lower end of cascade 294A is FET 234A1, which is not within the main body of the cascade 294A, but is at one end thereof. The source of FET 234A1 is connected to the drain 32*d* of FET 32. On the other or upper end of cascade 294A, the transresistance device is FET 234A3, and it has its drain 234A3 connected to port $\mathbf{31}_2$ of beam voltage regulator 30.

Cascade 294A of controllable resistance element A of beam voltage regulator 30 of FIG. 2 also includes a resistance-capacitance voltage divider designated generally as 292A, having taps coupled to the control electrodes or gates of the additional transresistance elements or FETs. More particularly, cascade 294A of controllable resistance element A of beam voltage regulator 30 includes a resistive voltage divider 292A having a cascade of four resistors 292A0, 292A1, 292A3, and 292A4, with tap 292A01 between resistors 292A0 and 292A1, tap 292A12 between resistors 292A1 and 292A2, and tap 292A23 between resistors 292A2 and 292A3. The upper end of voltage divider 292A is connected to port or terminal $\mathbf{31}_2$ of beam voltage regulator 30, and the lower end is connected to ground terminal 31*g*. Each resistor 292A0, 292A1, 292A2, and 292A3 is paralleled by a capacitor, for improving the transient response of the additional transresistance devices. Taps 292A01, 292A12, and 292A23 of voltage divider 294A are connected, each by way of a current-limiting resistor (not designated), to the gates 234A1*c*, 234A2*c*, and 234A3*c* of FETs 234A1, 234A2, and 234A3, respectively, for tending to maintain equal voltages across the FETs.

Controller B includes a transresistance element in the form of a FET 232 including a source 232*s*, a drain 232*d*, and a control electrode 232*g*. Source 232*s* is connected to one terminal of a sense resistor 233, the other end or terminal 233*lt* of which is connected to ground G. Drain 232*d* of FET 232 is connected to terminal $\mathbf{31}_2$ of beam voltage regulator 30 by a cascade 294B of additional transresistance devices, which are illustrated as being FETs. Cascade 294B includes a FET 234B1 having source 234B1*s*, a drain 234B1*d*, and a control electrode or gate 234B1*c*; a FET 234B2 having drain 234B2*d*, a control electrode or gate 234B2*c*, and source 234B2*s* connected to the drain 234B1*d* of FET 234B1; and a FET 234B3 having a drain 234B3*d*, control electrode or gate 234B3*c*, and a source 234B3*s* connected to the drain 234B1*d* of FET 234B2. Thus, within the main portion of cascade 294B, each FET, such as FET 234B2, has its source, such as source 234B2*s*, connected to the drain, such as drain 234B1*d*, of the next adjacent FET 234B1, on one side in the cascade 294B, and has its drain, such as drain 234B2*d*, connected to the source, such as source 234B3*d*, of the next adjacent FET, 234B3, on the other side of it in the cascade 294B. The last transresistance device on the lower end of cascade 294B is FET 234B1, which is not within the main body of the cascade 294B, but is at one end thereof. The source of FET 234B1 is connected to the drain 232*d* of FET 232. On the other or upper end of cascade 294B, the transresistance device is FET 234B3, and it has its drain 234B3 connected to port $\mathbf{31}_2$ of beam voltage regulator 30.

Cascade 294B of controllable resistance element B of beam voltage regulator 30 of FIG. 2 also includes a resistance-capacitance voltage divider designated generally as 294B, having taps coupled to the control electrodes or gates of the additional transresistance elements or FETS. More particularly, cascade 294B of controllable resistance element B of beam voltage regulator 30 includes a resistive voltage divider 294B having a cascade of four resistors 294B0, 294B1, 294B2, and 294B3, with tap 294B01 between resistors 294B0 and 294B1, tap 294B12 between resistors 294B1 and 294B2, and tap 294B23 between resistors 294B2 and 294B3. The upper end of voltage divider 294B is connected to port or terminal $\mathbf{31}_2$ of beam voltage regulator 30, and the lower end is connected to ground terminal 31*g*. Each resistor 294B0, 294B1, 294B2, and 294B3 is paralleled by a capacitor (not designated), for improving the transient response of the additional transresistance devices. Taps 294B01, 294B12, and 294B23 of voltage divider 294B are connected, each by way of a current-limiting resistor (not designated), to the gates 234B1*c*, 234B2*c*, and 234B3*c*, respectively, of FETs 234B1, 234B2, and 234B3, respectively, for tending to maintain equal voltages across the FETs.

Within high power output stage 31 of FIG. 2, the two variable-impedance cascades 294A and 294B have separate signal input ports. The signal input port for cascade 294A is gate 32*g* of FET 32, and the signal input port for cascade 294B is gate 232*g* of FET 232. In principle, the currents would be equal in the two cascades if the input signals were identical and the cascades themselves were identical. However, current sharing can be guaranteed by a control arrangement 240 which provides feedback to tend to maintain substantially equal current through the two cascades 294A and 294B. More particularly, current control arrangement 240 includes wide bandwidth amplifiers 242 and 244, each including an inverting (–) and a noninverting (+) input port. The inverting input ports of amplifiers 242 and 244 are connected to the non-grounded ends of sensing resistors 33 and 233, respectively. So long as the resistors 33 and 233 have the same resistance, and the currents therethrough are equal, their sensed voltages should also be equal. The noninverting input terminals of amplifiers 33 and 233 are connected together to define port 31*c* of power stage 31, and to receive the error signal from cathode control circuit 36.

In addition to the resistors and capacitors illustrated as being associated with the TWT 12, those skilled in the art know that additional capacitors and resistors may be required for filtering, for capacitor bleed-down, and for current limiting during fault conditions. Capacitor 264 is selected in conjunction with the gain of the control loop for best pulse rise time damping of the cathode voltage of the TWT 12.

The response time of the arrangement according to the aspect of the invention illustrated in FIG. 2, by comparison with that of FIG. 1, is quite improved. More particularly, the control bandwidth is about 50 kHz. in the FIG. 1 arrangement, and the FIG. 2 embodiment has a control bandwidth in the range of 500 kHz to 1 MHz. In addition, the paralleling of the "stacks 294" of solid-state devices tends to reduce the power which has to be handled by any one of the devices. The current-equalizing aspect of the invention further tends to minimize potentially destructive excess power in any one of the solid-state power devices of output stage 31 of FIG. 2. Finally, the arrangement is more shock and vibration resistant.

Other embodiments of the invention will be apparent to those skilled in the art. For example, while each "stack" or cascade 294A, 294B of solid state devices has been illustrated as including one control device (such as 32) and three cascaded devices (such as 234A1, 234A2, and 234A3) for limiting the voltage which the control device must sustain, in some versions of the invention the number of such cascaded devices may be one, or two, or may be in a number in excess of three. In the same manner, the total current which the cathode beam voltage regulator 30 must handle may be distributed among more than two stacks or cascades (294*a*, 294*b*). Further stacks can be paralleled with the illustrated stacks 294A and 294B with an additional wide-band amplifier 242 for each stack, together with the additional stack, its resistive voltage divider, and a current sense resistor to ground.

Thus, in very general terms, a power supply for a travelling-wave tube (TWT) includes a beam power supply (14) connected to the cathode and collector of the TWT, and a further power supply (20) connected to ground and to the collector for establishing the cathode-to-body voltage. A feedback cathode voltage regulator includes a transresistance arrangement (31) connected between ground and a terminal of the further power supply which, in one version, includes a cascade of a control transresistance device (32) with a plurality of further transresistance devices (234*s*) for reducing the voltage to which the control device is subjected. In another version, a plurality of such transresistance arrangements (A,B) are paralleled for reducing the power which any one device must handle. In a preferred embodiment, a current equalizer (240) equalizes the load carried by each of the transresistance arrangements (A,B).

More particularly, a power supply (210) for a travelling-wave tube (12) (TWT) according to an aspect of the invention provides voltage for the cathode-to-collector (12*co*) beam of a travelling-wave tube (12). The travelling-wave tube (12) includes a cathode (12*ca*), a collector (12*co*), and a body (12*b*) connected to ground (Gnd) or other reference voltage source. The power supply (210) includes a first voltage source (14) including a negative (–) terminal and a positive (+) terminal coupled to the collector (12*co*) of the travelling-wave tube (12). An electrical coupling arrangement (18), such as a conductor or a current-limiting resistor, is coupled to the negative (–) terminal of the first voltage source (14) and to the cathode (12*ca*) of the travelling-wave tube (12), for thereby establishing a cathode (12*ca*)-to-collector (12*co*) voltage of the travelling-wave tube (12) at a value near the first voltage. The power supply (210) also includes a controllable impedance (31; A) including a first terminal (31*g*) coupled to the ground (or other reference) and also including a second terminal ($31_2$). The controllable impedance (31; A) further includes a control terminal (31*c*) responsive to a control (error) signal for controlling the impedance between the first (31*g*) and second (312) terminals of the controllable impedance (31;A). In a particular embodiment, the controllable impedance (31;A) comprises (a) a sensing resistor (33) having one end coupled to the ground (or other reference); (b) a first controllable solid-state device (32) including first (source) and second (drain) electrodes, and a control electrode (31*c*) to which a control signal can be applied for controlling the impedance between the first (source) and second (drain) electrodes of the first controllable solid-state device (32). The first controllable solid-state device (32) has its first (source) electrode coupled to the ground (or other) reference by way of the sensing resistor (33), and also has its control electrode (31*c*) coupled to (or in common with) the control terminal (31*c*) of the controllable impedance (31;A). The controllable impedance (31;A) also includes (b) at least two additional controllable solid-state devices (234A1, 234A2; 234A1, 234A3), each of the additional controllable solid state devices (234A1, 234A2; 234A1, 234A3) including first (234A1*s*, 234A2*s*; 234A1*s*, 234A3*s*) and second (234A1*d*, 234A2*d*; 234A1*d*, 234A3*d*) electrodes and a control electrode (234A1*c*, 234A2*c*; 234A1*c*, 234A3*c*) to which a control signal can be applied for controlling the impedance between the first (234A1*s*, 234A2*s*; 234A1*s*, 234A3*s*) and second (234A1*d*, 234A2*d*; 234A1*d*, 234A3*d*) electrodes thereof. The additional controllable solid-state devices (234A1, 234A2; 234A1, 234A3) are in a cascade (294A) in which each such cascaded additional solid-state device (234A1, 234A2; 234A1, 234A3), except those (234A1, 234A3) at the ends of the cascade (294A), has its second electrode (234A2*d*) coupled to the first electrode (234A2*s*) of the next adjacent one of the additional controllable solid-state devices (234A3) in the cascade, and in which the first electrode (234A1*s*) of that one (234A1) of the additional controllable solid-state devices (234A1, 234A2; 234A1, 234A3) at a first end (the lower end as illustrated in FIG. 2) of the cascade (294A) is connected to the second electrode (32*d*) of the first controllable solid-state device (32), and in which the second electrode (234A3*d*) of that one (234A3) of the additional controllable solid-state devices (234*a*1, 234*a*2; 234*a*1, 234*a*3) at a second end (the upper end as illustrated) of the cascade (294A) is connected to, or common with, the second terminal ($31_2$) of the controllable impedance (31;A). Additionally, the controllable impedance (31;A) includes (c) means (292A) for equalizing the voltages applied between the first (source) and second (drain) terminals of the additional controllable solid-state devices (234A1, 234A2; 234A1, 234A3). The power supply (210) further includes a second voltage source (20) including a negative (−) terminal coupled to the collector (12*co*) of the travelling-wave tube (12) and a positive (+) terminal connected to the second terminal ($31_2$) of the controllable impedance (31;A), and a cathode (12*ca*)-to-ground (G) voltage controller (36) coupled to the cathode (12*ca*) of the travelling-wave tube (12), to the ground (G), and to the control terminal (31*c*) of the controllable impedance (31;A), for controlling the control signal in a manner which tends to maintain the voltage between the ground (G) and the cathode (12*ca*) of the travelling-wave tube (12) constant. In an embodiment of the invention, the voltage controller is of the feedback type.

In a preferred embodiment, the power supply (210) further comprises a capacitance arrangement (16) coupled across the first voltage source (14). In another embodiment, the means (292A) for equalizing the voltages includes a resistive voltage divider (292A0, 292A1, 292A3) defining plural taps (292A01, 292A12, 292A23), with the taps (292A01, 292A12, 292A23) of the resistive voltage divider (292A0, 292A1, 292A3) being connected to the control electrodes (234A1*c*, 234A2*c*, 234A3*c*) of the additional controllable solid-state devices (234A1, 234A2; 234A1, 234A3). In yet another embodiment of the invention, a second controllable impedance (B; 232, 233, 294B) includes a first terminal (233*lt*) coupled to the ground (or other reference) and also includes a second terminal (234B3*d*, $31_2$) coupled to the positive (+) terminal of the second voltage source (20). The second controllable impedance (B; 232, 233, 294B) further includes a control terminal (232*g*) responsive to a control signal for controlling the impedance between the first (233*lt*) and second (234B3*d*, $31_2$) terminals of the second controllable impedance (B; 232, 233, 294B), and means (240) are provided for coupling the cathode (12*ca*)-to-ground voltage controller (36) to the control electrodes (32*g*, 232*g*) of the first-mentioned (31;A) and second (B) controllable impedances, for parallel control of the first-mentioned (31;A) and second (B) controllable impedances. In one manifestation of this last embodiment, means (242, 244) are provided for tending to equalize the current through each of the first-mentioned (31;A) and second (B) controllable impedances, and in one version, this means includes a first sensing resistor (33) coupled between the ground and the first electrode (32*s*) of the first controllable solid-state device (32) of the first controllable impedance (31;A) for developing a signal representing the current through the first controllable solid-state device (32), and a second sensing resistor (233) connected between the first terminal (232*s*) of the first controllable solid-state device (232) of the second controllable impedance (B) and the ground, for developing a signal representing the current through the second controllable solid-state device (232) of the second controllable impedance (B), together with first (242) and second (244) amplifiers, each including an inverting (−) input port and a noninverting (+) input port, where the inverting input ports of the first (242) and second (244) amplifiers are connected to the first (33) and second (233) sensing resistors, respectively, and the noninverting input ports of the first (242) and second (244) amplifiers are connected in common to the cathode (12*ca*)-to-ground voltage controller (36) for receiving the control signal therefrom.

Another avatar of the invention lies in a power supply (210) for the cathode (12*ca*)-to-collector (12*co*) beam of a travelling-wave tube (12) including a cathode (12*ca*), a body (12*b*) connected to ground (or other reference potential), and a collector (12*co*). In this avatar, the power supply (210) comprises a first direct voltage source (14) including a negative (−) terminal, and also includes a positive (+) terminal coupled to the collector (12*co*) of the travelling-wave tube (12). An electrical coupling means (18*a*, 18*b*) is coupled to the negative (−) terminal of the first voltage source (14) and to the cathode (12*ca*) of the travelling-wave tube (12), for thereby establishing a cathode (12*ca*)-to-collector (12*co*) voltage of the travelling-wave tube (12) at a value near, or ideally at, the first voltage. A first controllable impedance (31;A) includes a first terminal (31*g*) coupled to the ground (or other reference) and also includes a second terminal ($31_2$). The first controllable impedance (31;A) further includes a control terminal (32*g*) responsive to a control signal for controlling the impedance between the first (31*g*) and second ($31_2$) terminals of the first controllable impedance (31;A). A second controllable impedance (B) includes a first terminal (233*lt*) coupled to the ground (or other reference) and also includes a second terminal (234B3*d*). The second controllable impedance (B) further includes a control terminal (232*g*) responsive to a control signal for controlling the impedance between the first (233*lt*) and second (234B3*d*) terminals of the second controllable impedance (B). A second voltage source (20) includes a negative terminal coupled to the collector (12*co*) of the travelling-wave tube (12) and a positive terminal connected to the second terminals of the first (31;A) and second (B) controllable impedances, and a cathode (12*ca*)-to-ground voltage controller (36) coupled to the cathode (12*ca*) of the travelling-wave tube (12), to the ground (or other reference), and to the control terminals (32*g*, 232*g*) of the first (31;A) and second (B) controllable impedances, for controlling the control signal in a manner which tends to maintain constant the voltage between the ground (or other reference) and the cathode (12*ca*) of the travelling-wave tube (12).

In a particular manifestation of this avatar, a capacitance means (16) is coupled across the first voltage source (14). In another particular manifestation, the coupling means (18*a*, 18*b*) comprises a resistance. In one version of this avatar, each of the controllable impedances (31: A,B) comprises (a) a resistor (33, 233) having one end coupled to the ground or other reference, (b) a first controllable solid-state device (32, 232) including first (source or its equivalent) and second (drain or its equivalent) electrodes, and a control electrode (gate or its equivalent) to which a control signal can be applied for controlling the impedance between the first (source &tc) and second (drain &tc) electrodes. This first controllable solid-state device (32, 232) has the first electrode (source &) coupled to the ground (or other reference) by way of the resistor (33, 233), and also has the control electrode (gate &) coupled to the control terminal (31*c*) of the controllable impedance (31:A,B). This version of the avatar also includes (b) at least two additional controllable solid-state devices (234A1, 234A2; 234B1, 234B2), where each the additional controllable solid state device includes first and second electrodes and a control electrode to which a control signal can be applied for controlling the impedance between the first and second electrodes. The additional controllable solid-state devices are coupled in a cascade in which each such cascaded solid-state device, except those at the ends of the cascade, has its second electrode coupled to the first electrode of the next adjacent one of the additional controllable solid-state devices in the cascade, and in which the first electrode of that one of the additional controllable solid-state devices at a first end of the cascade is connected to the second electrode of the first controllable solid-state device, and in which the second electrode of that one of the additional controllable solid-state devices at a second end of the cascade is connected to the second terminal of the controllable impedance; and (c) means for equalizing the voltages applied between the first and second terminals of the additional controllable solid-state devices.

What is claimed is:

1. A power supply for the cathode-to-collector beam of a travelling-wave tube including a cathode, a body connected to ground, and a collector, said power supply comprising:

a first voltage source including a negative terminal, and also including a positive terminal coupled to said collector of said travelling-wave tube;

electrical coupling means coupled to said negative terminal of said first voltage source and to said cathode of said travelling-wave tube, for thereby establishing a cathode-to-collector voltage of said travelling-wave tube near said first voltage;

a controllable impedance including a first terminal coupled to said ground and also including a second terminal, said controllable impedance further including a control terminal responsive to a control signal for controlling the impedance between said first and second terminals of said controllable impedance, said controllable impedance comprising (a) a resistor having one end coupled to said ground;

(b) a first controllable solid-state device including first and second electrodes, and a control electrode to which a control signal can be applied for controlling the impedance between said first and second electrodes, said first controllable solid-state device having said first electrode coupled to said ground by way of said resistor, and also having said control electrode coupled to said control terminal of said controllable impedance;

(b) at least two additional controllable solid-state devices, each said additional controllable solid state device including first and second electrodes and a control electrode to which a control signal can be applied for controlling the impedance between said first and second electrodes, said additional controllable solid-state devices being in a cascade in which each such cascaded solid-state device, except those at the ends of said cascade, has its second electrode coupled to the first electrode of the next adjacent one of said additional controllable solid-state devices in said cascade, and in which the first electrode of that one of said additional controllable solid-state devices at a first end of said cascade is connected to said second electrode of said first controllable solid-state device, and in which the second electrode of that one of said additional controllable solid-state devices at a second end of said cascade is connected to said second terminal of said controllable impedance; and (c) means for equalizing the voltages applied between said first and second terminals of said additional controllable solid-state devices;

a second voltage source including a negative terminal coupled to said collector of said travelling-wave tube and a positive terminal connected to said second terminal of said controllable impedance; and a cathode-to-ground voltage controller coupled to said cathode of said travelling-wave tube, to said ground, and to said control terminal of said controllable impedance, for controlling said control signal in a manner which tends to maintain the voltage between said ground and said cathode of said travelling-wave tube constant.

2. A power supply according to claim 1, further comprising capacitance means coupled across said first voltage source.

3. A power supply according to claim 2, wherein said coupling means comprises a resistance.

4. A power supply according to claim 1, wherein said means for equalizing the voltages includes a resistive voltage divider defining plural taps, said taps of said resistive voltage divider being connected to said control electrodes of said additional controllable solid-state devices.

5. A power supply according to claim 1, further comprising:

a second controllable impedance including a first terminal coupled to said ground and also including a second terminal coupled to said negative terminal of said second power supply, said second controllable impedance further including a control terminal responsive to a control signal for controlling the impedance between said first and second terminals of said controllable impedance; and means coupling said cathode-to-ground voltage controller to said control electrodes of said first-mentioned and second controllable impedances, for parallel control of said first-mentioned and second controllable impedances.

6. A power supply according to claim 5, further comprising means for tending to equalize the current through each of said first-mentioned and second controllable impedances.

7. A power supply according to claim 6, wherein said means for tending to equalize the current comprises:

a first sensing resistor coupled between said ground and said first electrode of said first controllable solid-state device for developing a signal representing the current through said first controllable solid-state device;

a second sensing resistor connected between said first terminal of said second controllable impedance and said ground for developing a signal representing the current through said second controllable impedance;

first and second amplifiers, each including an inverting input port and a noninverting input port, said inverting input ports of said first and second amplifiers being connected to said first and second sensing resistors, respectively, and said noninverting input ports of said first and second amplifiers being connected in common to said cathode-to-ground voltage controller for receiving said control signal therefrom.

8. A power supply for the cathode-to-collector beam of a travelling-wave tube including a cathode, a body connected to ground, and a collector, said power supply comprising:

a first direct voltage source including a negative terminal, and also including a positive terminal coupled to said collector of said travelling-wave tube electrical coupling means coupled to said negative terminal of said first direct voltage source and to said cathode of said travelling-wave tube, for thereby establishing a cathode-to-collector voltage of said travelling-wave tube at a value near said first voltage;

a first controllable impedance including a first terminal coupled to said ground and also including a second terminal, said first controllable impedance further including a control terminal responsive to a control signal for controlling the impedance between said first and second terminals of said first controllable impedance;

a second controllable impedance including a first terminal coupled to said ground and also including a second terminal, said second controllable impedance further including a control terminal responsive to a control signal for controlling the impedance between said first and second terminals of said second controllable impedance;

a second direct voltage source including a negative terminal coupled to said collector of said travelling-wave tube and a positive terminal connected to said second terminal of said first and second controllable impedances; and a cathode-to-ground voltage controller coupled to said cathode of said travelling-wave tube, to said ground, and to said control terminals of said first and second controllable impedances, for controlling said control signal in a manner which tends to maintain constant the voltage between said ground and said cathode of said travelling-wave tube.

9. A power supply according to claim 8, further comprising capacitance means coupled across said first voltage source.

10. A power supply according to claim 8, wherein said coupling means comprises a resistance.

11. A power supply according to claim 8, wherein each of said controllable impedances comprises:

(a) a resistor having one end coupled to said ground;

(b) a first controllable solid-state device including first and second electrodes, and a control electrode to which a control signal can be applied for controlling the impedance between said first and second electrodes, said first controllable solid-state device having said first electrode coupled to said ground by way of said resistor, and also having said control electrode coupled to said control terminal of said controllable impedance;

(c) at least two additional controllable solid-state devices, each said additional controllable solid state device including first and second electrodes and a control electrode to which a control signal can be applied for controlling the impedance between said first and second electrodes, said additional controllable solid-state devices being in a cascade in which each such cascaded solid-state device, except those at the ends of said cascade, has its second electrode coupled to the first electrode of the next adjacent one of said additional controllable solid-state devices in said cascade, and in which the first electrode of that one of said additional controllable solid-state devices at a first end of said cascade is connected to said second electrode of said first controllable solid-state device, and in which the second electrode of that one of said additional controllable solid-state devices at a second end of said cascade is connected to said second terminal of said controllable impedance; and (d) means for equalizing the voltages applied between said first and second terminals of said additional controllable solid-state devices.

* * * * *